US007749026B1

(12) United States Patent
Li et al.

(10) Patent No.: US 7,749,026 B1
(45) Date of Patent: Jul. 6, 2010

(54) ISOLATOR

(75) Inventors: Chun-Yi Li, Budai Township, Chiayi County (TW); Chih-Pin Yao, Tainan (TW)

(73) Assignee: Soontai Tech Co., Ltd., Tainan County (TW)

( * ) Notice: Subject to any disclaimer, the term of this patent is extended or adjusted under 35 U.S.C. 154(b) by 0 days.

(21) Appl. No.: 12/457,865

(22) Filed: Jun. 24, 2009

(51) Int. Cl.
*H01R 13/66* (2006.01)

(52) U.S. Cl. ..... 439/620.03

(58) Field of Classification Search ..... 439/620.03, 439/620.01, 620.1, 578, 939, 620.29
See application file for complete search history.

(56) References Cited

U.S. PATENT DOCUMENTS 4,500,160 A * 2/1985 Bertsch ..... 439/56
4,968,267 A * 11/1990 Payne ..... 439/410
5,413,504 A * 5/1995 Kloecker et al. ..... 439/620.03
6,064,895 A * 5/2000 Baumfalk et al. ..... 505/210
6,152,743 A * 11/2000 Fox ..... 439/63
6,506,079 B1 * 1/2003 Dingenotto et al. ..... 439/620.1
6,952,339 B1 * 10/2005 Knowles ..... 361/528
7,101,226 B1 * 9/2006 Gilliland ..... 439/620.01
7,318,744 B2 * 1/2008 Kuo ..... 439/489

* cited by examiner

*Primary Examiner*—Chandrika Prasad
(74) *Attorney, Agent, or Firm*—Rosenberg, Klein & Lee

(57) ABSTRACT

This invention relates to an isolator. Primarily, an insulation cover is inserted by a connector being disposed with a plug-in unit. At least one iron core is disposed around a tube at the other end of a connector. A front cover is connected with a fixing seat having a first space and a second space in which first and second ring capacitors are respectively received. An insulation sleeve is arranged between the first and second ring capacitors. One end of each ring capacitor is disposed with a circular spring correspondingly. The other end of the fixing seat is connected to an outer tube, the outer end of which is arranged with a terminal portion with a plug-in unit mounted therein. Thereby the simplified structure of the isolator with an isolated ground effect improves the impedance matching and has properties of better bandwidth flatness, lower insertion loss, and better return loss.

1 Claim, 3 Drawing Sheets

| 1:Mkr ( MHz ) | | dB | 2:Mkr ( MHz ) | | dB |
|---|---|---|---|---|---|
| 1: | 5.0000 | - 0.243 | 1: | 5.0000 | - 22.385 |
| 2: | 250.0000 | - 0.110 | 2: | 250.0000 | - 26.363 |
| 3: | 500.0000 | - 0.259 | 3: | 500.0000 | - 21.597 |
| 4: | 750.0000 | - 0.315 | 4: | 750.0000 | - 20.068 |
| 5> | 1000.0000 | - 0.381 | 5> | 1000.0000 | - 21.230 |

ISOLATOR

BACKGROUND OF THE INVENTION

1. Fields of the Invention

The present invention relates to an isolator, especially to an isolator with compact volume for convenience of assembling, processing, and isolating interference caused by poor ground loop during signal transmission so as to improve impedance matching. Moreover, the device has better bandwidth flatness, lower insertion loss, and better return loss so that signals with better waveforms are obtained by the isolator.

2. Descriptions of Related Art

The CATV system with two-way communication ability uses coaxial cables (or optical cables) to deliver television signals from cable television companies with equipments, called the head end to end users' homes (subscriber end). The cable television or telecommunication system companies receive various sources of programs such as satellite signals, wireless signals or microwave signals of television stations or broadcast stations by different antennas or air self-produced programs. The various signals are processed by the equipments in the head end and then are sent to the users' end by cables. During the processes, various components with different functions such as filtering, amplification and distribution etc are used.

As shown in Taiwanese Pub. App. No. M244634, published on Sep. 21, 2004, a common isolator such as an RF (radio frequency) adaptor is revealed. The RF adaptor is disposed on a signal transmission device and is connected with a terminal with RF wire. The RF adaptor consists of a main body having an insertion hole corresponding to the terminal and a channel connected with the insertion hole, a transmit member located in the channel of the main body and transmitting the RF signals into the signal transmission device after being electrically connected with the inserted terminal, and an isolation member mounted in the channel. The isolation member includes a first capacitor on one end of the channel, a second capacitor on the other end of the channel, and an inductor connected serially between the first capacitor and the second capacitor. The transmit member inserts through the isolation member while the isolation member is for isolating noise except the signal from the terminal when the terminal inserts into the main body.

The above RF adaptor is disposed on a signal transmission device and is connected with a terminal with RF wire. However, in practice, the impedance matching of the device in the high-frequency passband is not good. Thus the higher the frequency is, the larger the loss of high frequency signal is. Therefore there is a need to improve the design and structure of the device.

In order to overcome above shortcomings, refer to Taiwanese Pub. App. No. M331765, a novel isolator is provided. The isolator includes a connector, a first ring capacitor, a second ring capacitor, and a circuit substrate assembled inside a housing. The insulation cover is inserted by a connector that is disposed with a plug-in unit. An assembling protrusion is arranged at the other end of the connector and a stopper is disposed around the connector. At least one iron core is disposed around the assembling protrusion of the connector. The front cover is connected with a fixing seat whose two ends are depressed to form a first space and a second space. A first ring capacitor and a second ring capacitor are respectively received inside the first space and the second space. A circular spring is arranged at one end of the first ring capacitor as well as one end of the second ring capacitor correspondingly. The other end of the fixing seat is connected with an outer tube that is mounted with a circuit substrate. A terminal portion with a plug-in unit mounted therein is arranged at an outer end of the outer tube.

In accordance with the structure mentioned above, the disadvantages of the RF adaptor are improved, the impedance matching of the device is improved and the device has better bandwidth flatness, lower insertion loss, and better return loss property. Thus signals with better waveforms are obtained.

SUMMARY OF THE INVENTION

Therefore it is a primary object of the present invention to provide an isolator that includes an insulation cover mounted in a front cover of a housing. The insulation cover is inserted by a connector that is mounted with a plug-in unit. A tube is disposed on the other end of the connector and at least one iron core is disposed around the tube of the connector. The front cover is connected with a fixing seat whose two ends are concaved inward to form a first space and a second space: A first ring capacitor and a second ring capacitor are respectively loaded into the first space and the second space. An insulation sleeve is arranged between the first ring capacitor and the second ring capacitor. A circular spring is disposed on one end of the first ring capacitor as well as one end of the second ring capacitor correspondingly. An outer tube for mounting a circuit substrate is connected with the other end of the fixing seat. A terminal portion with a plug-in unit mounted therein is arranged at an outer end of the outer tube. Thereby the isolator structure is simplified and an isolated ground is obtained. Moreover, the impedance matching is improved and the device has better bandwidth flatness, lower insertion loss, and better return loss property.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
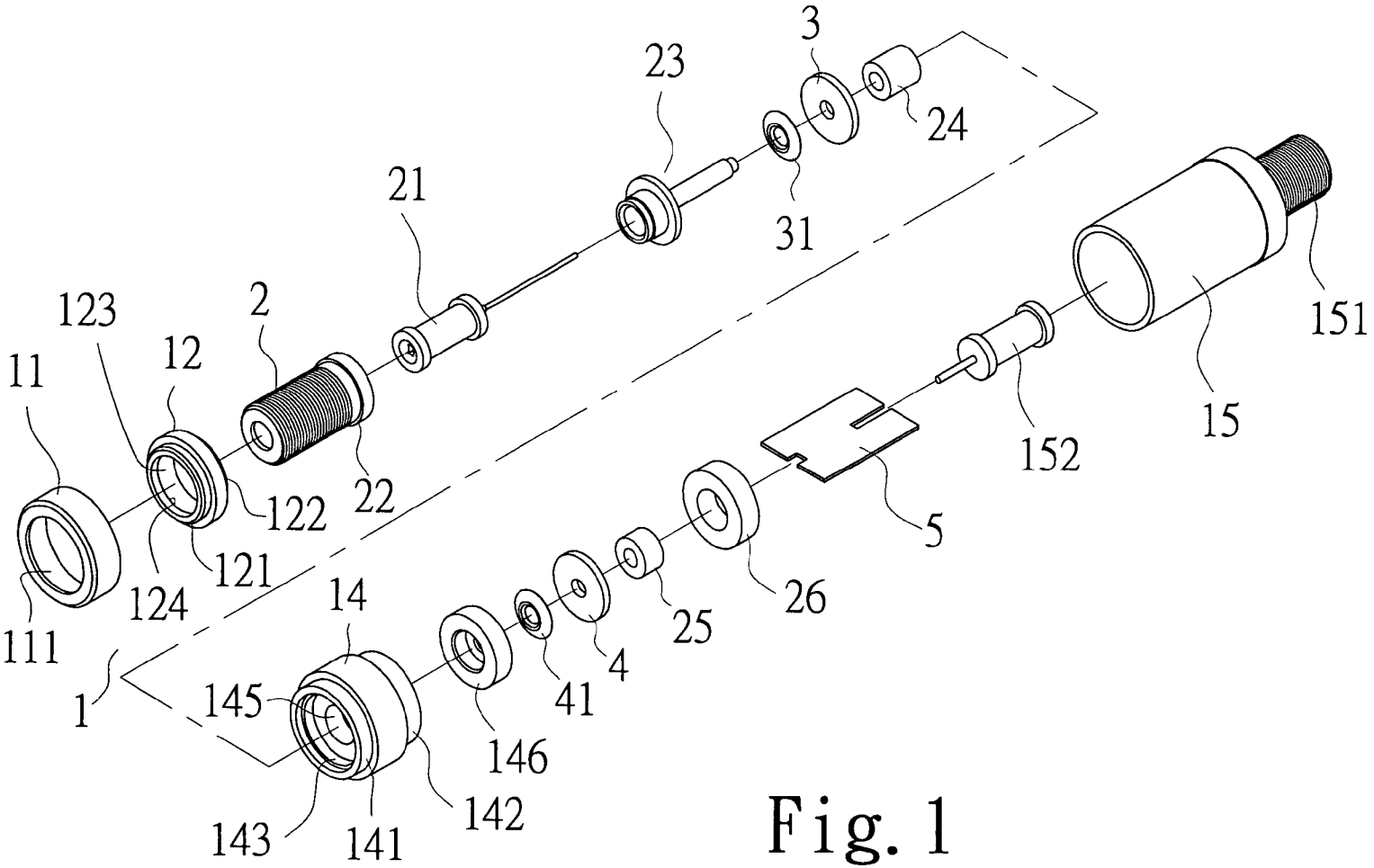
FIG. 1 is an explosive view of an embodiment according to the present invention.
Figure 2:
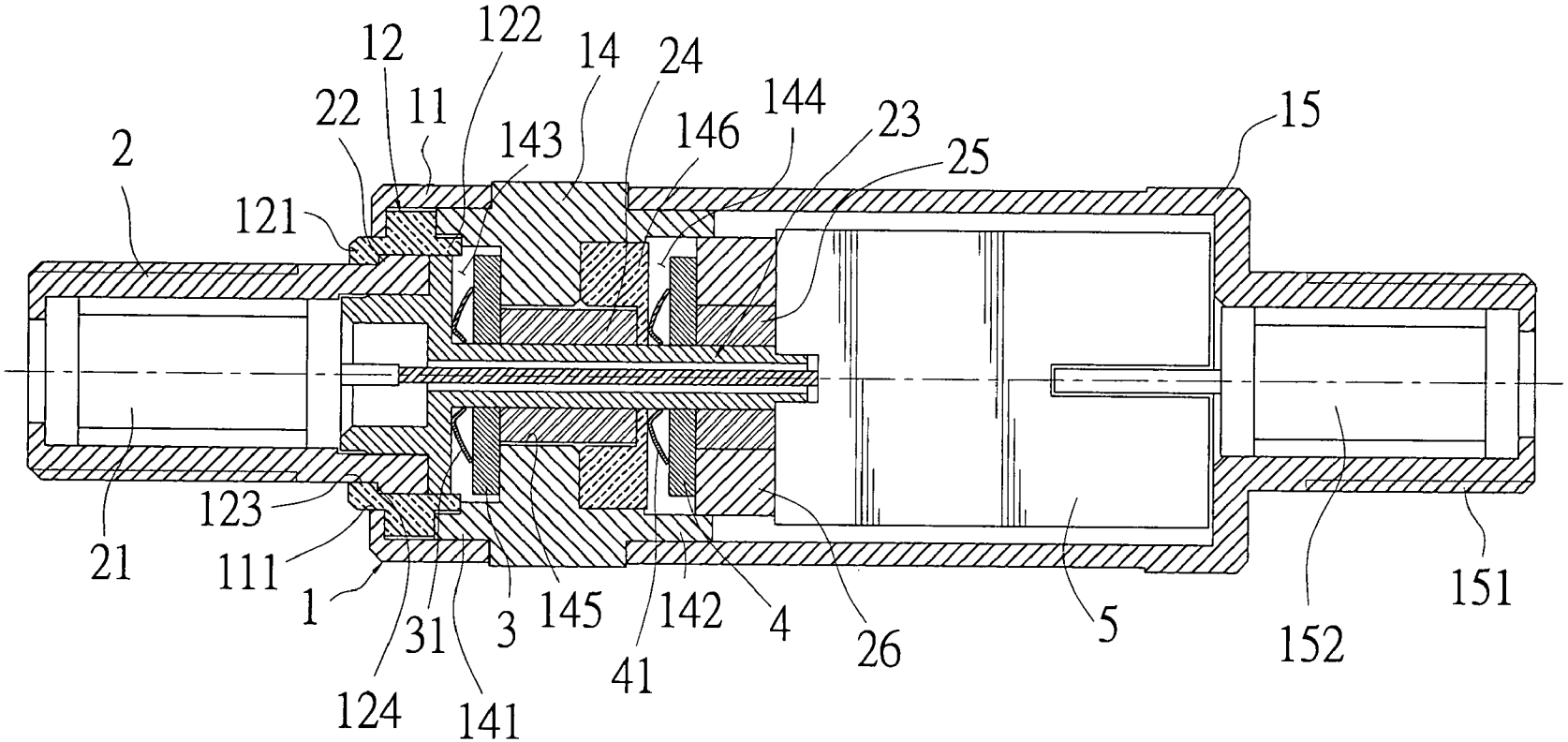
FIG. 2 is a cross sectional view of an assembled embodiment according to the present invention.

Refer to FIG. 1 and FIG. 2, an explosive view and a cross sectional view of an embodiment according to the present invention are revealed.

An isolator includes a connector (2), a first ring capacitor (3), a second ring capacitor (4), and a circuit substrate (5) assembled inside a housing (1).

The housing (1) is disposed with a front cover (11) having a penetrating insertion hole (111). An insulation cover (12) is mounted in the front cover (11). A flange (121) is arranged at one end of the insulation cover (12), corresponding to the insertion hole (111) of the front cover (11) while an assembling protrusion (122) is disposed on the other end of the insulation cover (12). Moreover, the insulation cover (12) is also having an insertion hole (123) and a leaning edge (124) formed in the insertion hole (123). The insertion hole (123) of the insulation cover (12) is inserted by the connector (2). The connector (2) is mounted with a plug-in unit (21) and a supporting edge (22) formed on one end of the connector (2), corresponding to the leaning edge (124) in the insertion hole (123) of the insulation cover (12). On the other end of the connector (2), a tube (23) is assembled with and mounted in the connector (2). A first iron core (24) and a second iron core (25) are disposed around the tube (23).

A fixing seat (14) is connected and assembled with the front cover (11) of the housing (1). A mounted flange (141) and a mounted flange (142) respectively are projectingly disposed on each of two ends of the fixing seat (14). The two ends of the fixing seat (14) are depressed to form a first space (143) and a second space (144) respectively. A through hole (145) is disposed between the first space (143) and the second space (144) while the first space (143) and the second space (144) respectively receive the first ring capacitor (3) and the second ring capacitor (4). An insulation sleeve (146) arranged between the first ring capacitor (3) and the second ring capacitor (4) is disposed around the first iron core (24). A base (26) is covered outside the second iron core (25). One end of the first ring capacitor (3) and one end of the second ring capacitor (4) are disposed with a circular spring (31) and a circular spring (41) correspondingly. As to the other end of the fixing seat (14) of the housing (1), an outer tube (15) is connected thereof. The circuit substrate (5) is mounted in the outer tube (15), leaning against the base (26). Moreover, a terminal portion (151) with a plug-in unit (152) mounted therein is arranged at the other end of the outer tube (15) projectingly.

Thereby, as shown in FIG. 2, the front cover (11) of the housing (1) is mounted with the insulation cover (12) while the flange (121) of the insulation cover (12) in mounted into the insertion hole (111) of the front cover (11). The connector (2) is sleeved into the insertion hole (123) of the insulation cover (12) and the supporting edge (22) of the connector (2) just leans against the leaning edge (124) in the insertion hole (123) of the insulation cover (12). The outer end of the connector (2) exerts outside the insertion hole (111) of the front cover (11). The tube (23) is assembled with and mounted into the other end of the connector (2). Then the circular spring (31) and the first ring capacitor (3) are disposed around the tube (23).

Next the fixing seat (14) is assembled correspondingly. Between the fixing seat (14) and the tube (23), the first iron core (24) is disposed around the tube (23) while the insulation sleeve (146) is covered around the first iron core (24) and is located inside the second space (144) of the fixing seat (14) simultaneously. Then the circular spring (41), the second ring capacitor (4) and the second iron core (25) are further disposed around the tube (23). The base (26) is arranged outside the second iron core (25). After the first space (143) and the second space (144) being loaded with the first ring capacitor (3) and the second ring capacitor (4), the mounted flange (141) of the fixing seat (14) is sleeved between the front cover (11) and the assembling protrusion (122) of the insulation cover (12). Later, the circuit substrate (5) is mounted into the outer tube (15) and is leaning against the base (26). Then the outer tube (15) is assembled with the mounted flange (142) of the fixing seat (14).

Figure 3:
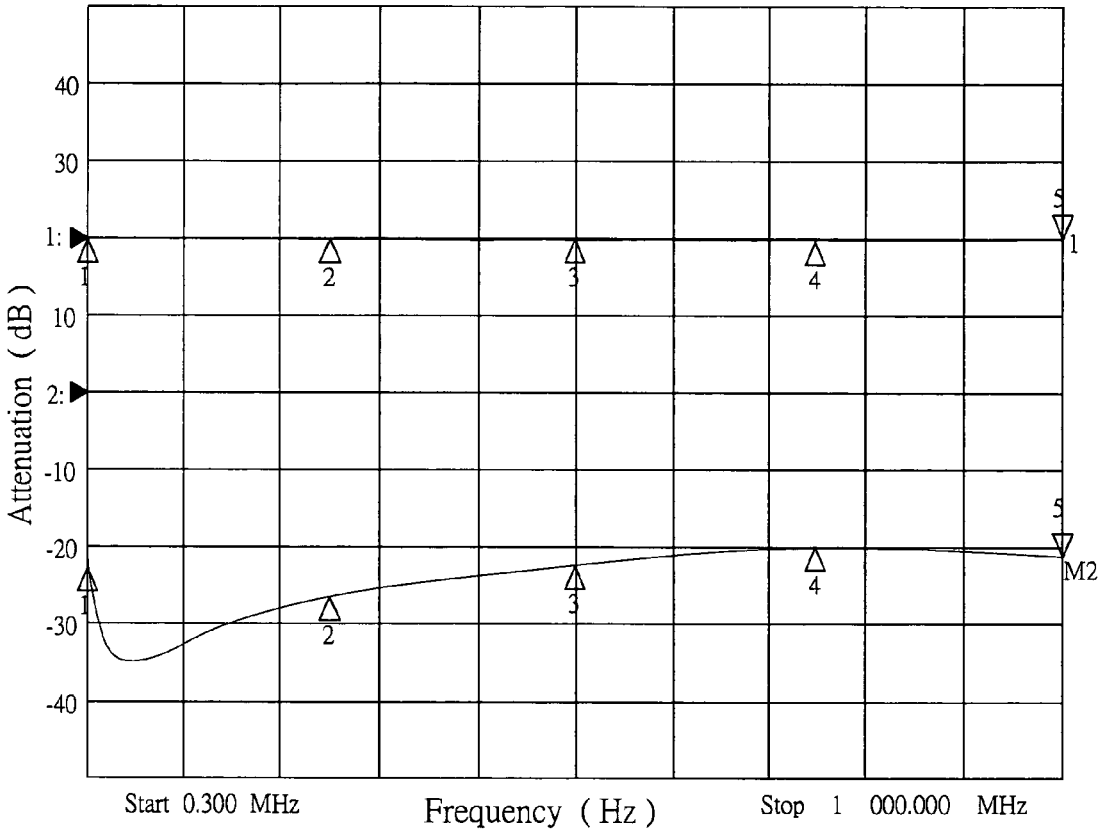
FIG. 3 shows curves of signals of an embodiment characterized by a RF network analyzer according to the present invention.

According to the above embodiments, the present invention doesn't require larger space to receive the components so that the manufacturing, processing and assembling are fast and convenient. While isolating the noise caused by poor ground loop during signal transmission, the impedance matching is improved. The device of the present invention is characterized by a RF network analyzer at RF (radio frequency) or microwave frequencies. Refer to the curve of measurement No. 1 (Meas1) in FIG. 3, in which Mkr1 is −0.243 db, 5 MHz, Mkr2 is −0.110 db, 250 MHz, Mkr3 is −0.259 db, 500 MHz, Mkr4 is −0.315 db, 750 MHz, Mkr5 is −0.381 db, 1000 MHz, the insertion loss is low and the curve is quite flat according to the degree of evenness. Moreover, refer to Mkr1~Mkr5 of a curve of Meas2, it is obvious that the present device has excellent return loss.

In summary, compared with structure available now, the isolator of the present invention has simpler structure that is beneficial to assembling and processing. The noise caused by poor ground loop during signal transmission is isolated and the impedance matching is improved. Moreover, the device has better bandwidth flatness, lower insertion loss, and optimal isolation effect.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An isolator comprising a connector, a first ring capacitor, a second ring capacitor, and a circuit substrate assembled inside a housing, wherein the housing is disposed with a front cover and an insulation cover mounted in the front cover; the insulation cover is inserted by a connector that is mounted with a plug-in unit while the other end of the connector is disposed with a tube that is disposed around by a first iron core and a second iron core; the front cover is connected with a fixing seat whose two ends are concaved inward to form a first space and a second space while a first ring capacitor and a second ring capacitor are respectively loaded into the first space and the second space and an insulation sleeve is arranged between the first ring capacitor and the second ring capacitor; a circular spring is disposed on one end of the first ring capacitor as well as one end of the second ring capacitor correspondingly; an outer tube for mounting a circuit substrate is connected with the other end of the fixing seat and a terminal portion with a plug-in unit mounted therein is arranged at an outer end of the outer tube.

* * * * *